US005888301A

United States Patent [19]

Jamieson

[11] Patent Number: 5,888,301

[45] Date of Patent: Mar. 30, 1999

[54] TILE-HOLDING FIXTURE FOR ADHESIVE APPLICATION

[76] Inventor: James W. Jamieson, 508 Acacia Ave., El Segundo, Calif. 90245

[21] Appl. No.: 80,172

[22] Filed: May 16, 1998

Related U.S. Application Data

[60] Provisional application No. 60/047,439 May 22, 1997.

[51] Int. Cl.[6] ..... B05C 13/00

[52] U.S. Cl. ..... 118/500; 118/504; 118/505; 427/282; 269/16; 269/293

[58] Field of Search ..... 118/500, 504, 118/505, 213, 301, 406; 427/282; 269/16, 293

[56] References Cited

U.S. PATENT DOCUMENTS

| | | | |
|---|---|---|---|
| 2,332,579 | 10/1943 | Kirby | 118/505 |
| 4,357,898 | 11/1982 | Fehrenbacher | 118/504 |
| 4,791,007 | 12/1988 | Gleason et al. | 118/505 |

*Primary Examiner*—Laura Edwards
*Attorney, Agent, or Firm*—Allen A. Dicke, Jr.

[57] ABSTRACT

The tile-holding fixture has a fixture wall with an adhesive mask opening therein. Stops adjacent the opening permit positioning of a tile on the face of the wall while tile adhesive is applied by the applicator through the mask opening. The fixture also has a scraper wall provides the combined function of scraping adhesive from the applicator and resting the applicator. The interior of the fixture serves as a reservoir for tile adhesive so that the proper amount of adhesive can be quickly and accurately applied.

20 Claims, 3 Drawing Sheets

TILE-HOLDING FIXTURE FOR ADHESIVE APPLICATION

CROSS-REFERENCE

This application relies upon provisional application, Ser. No. 60/047,439, filed May 22, 1997, for priority, the entire disclosure of which is incorporated herein.

FIELD OF THE INVENTION

This invention is directed to a fixture for holding a flat tile while adhesive is applied thereto. The fixture provides positioning of the tile, provides for masking of the tile so that adhesive is supplied to a predetermined area, provides for scraping off and holding the applicator blade, and provides for holding adhesive ready for application.

BACKGROUND OF THE INVENTION

Ceramic tile is employed as a floor surface and as a wall surface. Ceramic tile is attached to those surfaces by means of adhesive. The adhesive is applied to the tile or to the surface, and the tile is laid against the surface in a position in accordance with tile installation guidelines or tiles already in place. The use of the proper amount of adhesive is important to achieve the correct height of the tile with respect to the substrate surface. When the adhesive is placed on the back of the tile, is important so that it does not appear in the inter-tile spaces.

Present-day adhesive application is usually accomplished by laying four lumps of adhesive on the back of the tile, spaced from the corners. When the tile is placed against the substrate, these lumps spread out, but hopefully not to the extent that they appear in the inter-tile spaces The positioning and quantity of the lumps of adhesive require experience. This is part of the skill of the trade.

It is difficult to use and position the correct amount of adhesive. Therefore, the inexperienced homeowner who wants to set his own tile has problems in positioning and quantity of adhesive applied to the back of the tile. Thus, there-is need for a fixture which aids in the proper application of adhesive.

SUMMARY OF THE INVENTION

In order to aid in the understanding of this invention, it can be stated in essentially summary form that it is directed to a tile-holding fixture for adhesive application. The fixture has a face. There is an opening in the face and tile stops adjacent the opening so that a tile can be positioned with its back against the face of the fixture and adhesive can be applied through the opening in the fixture to position the adhesive properly with respect to the tile. The fixture may also serve as an adhesive holder and as an adhesive applicator scraper.

It is, thus, a purpose and advantage of this invention to provide a tile-holding fixture for adhesive application wherein the proper amount of adhesive is applied to the proper area of the back of a tile.

It is a further purpose and advantage of this invention to provide a tile-holding fixture wherein stops on the face of the fixture properly position the tile with respect to an opening in the fixture so that adhesive can be applied through the opening and the edges of the tile are masked by the edges of the opening.

It is a further purpose and advantage of this invention to provide a tile-holding fixture which permits an inexperienced person to apply the correct amount of adhesive to the back of the tile so that it may be set properly.

It is a further purpose and advantage of this invention to provide a tile-holding fixture which has multiple utility, including holding adhesive ready for application and an edge for scraping the adhesive applicator so that the adhesive can be handled conveniently.

Further purposes and advantages of this invention will become apparent from a study of the following portion of the specification, the claims and the attached drawings.

DESCRIPTION OF THE PREFERRED EMBODIMENT

Figure 3:
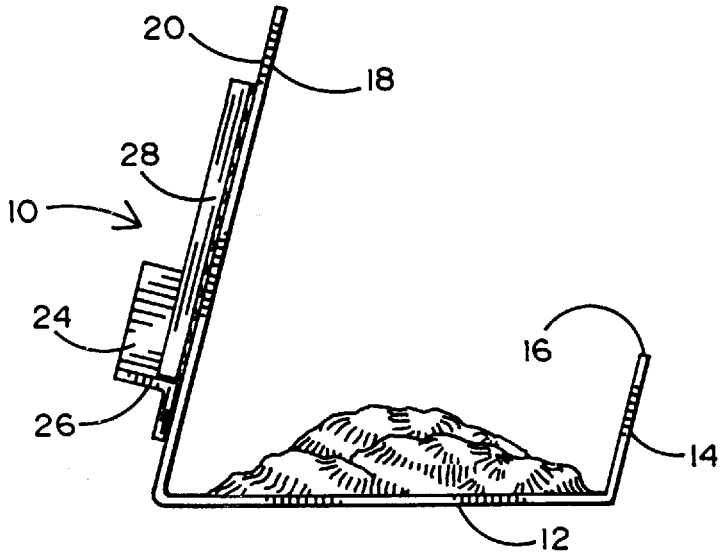
FIG. 3 is an end view thereof, showing a tile in position and showing adhesive stored in the fixture.

The tile-holding fixture for adhesive application of this invention is generally indicated at 10 in FIGS. 1, 2, 3 and 4. The fixture 10 has a base 12 which is substantially planar and which is of substantially uniform thickness. Upstanding from the back of the base is scraper wall 14. Scraper wall 14 is a flat panel which is attached to the base and which is at a right angle with the plane of the base or is obtusely angled with respect thereto. An appropriate obtuse angle is about 115 degrees with respect to the base, as shown in FIG. 3. The scraper edge has a straight edge at the top of the base. Scraper wall 14 is also preferably of uniform thickness.

Fixture wall 18 is also attached to the base at the front edge thereof. The fixture wall 18 is preferably acutely angled with respect to the base, such as at the 75 degree angle shown in FIG. 3. While the acute angle illustrated is preferred, the fixture wall may extend upward at a right angle with respect to the base. Fixture wall 18 has a face 20 which is preferably planar.

Figure 1:
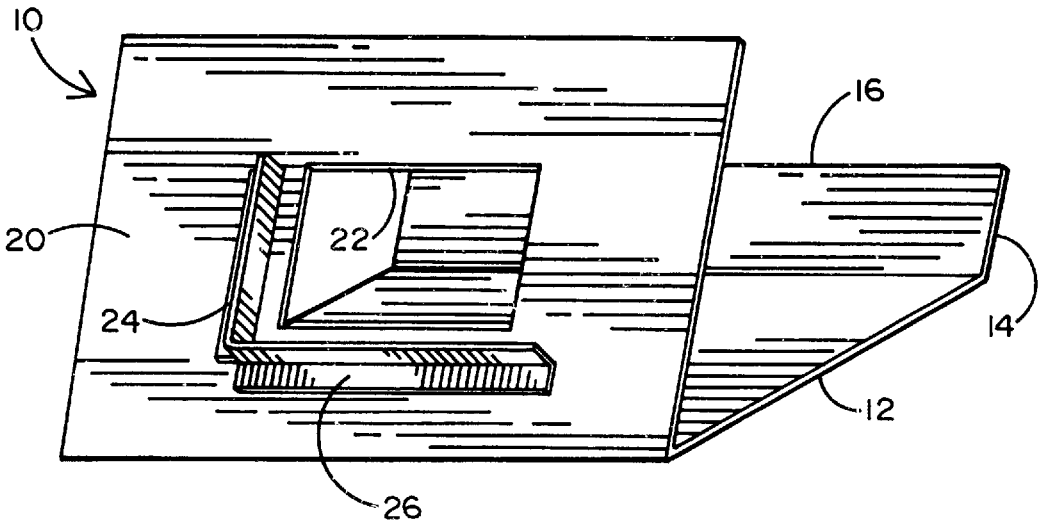
FIG. 1 is a front perspective view of the tile-holding fixture in accordance with this invention.
Figure 2:
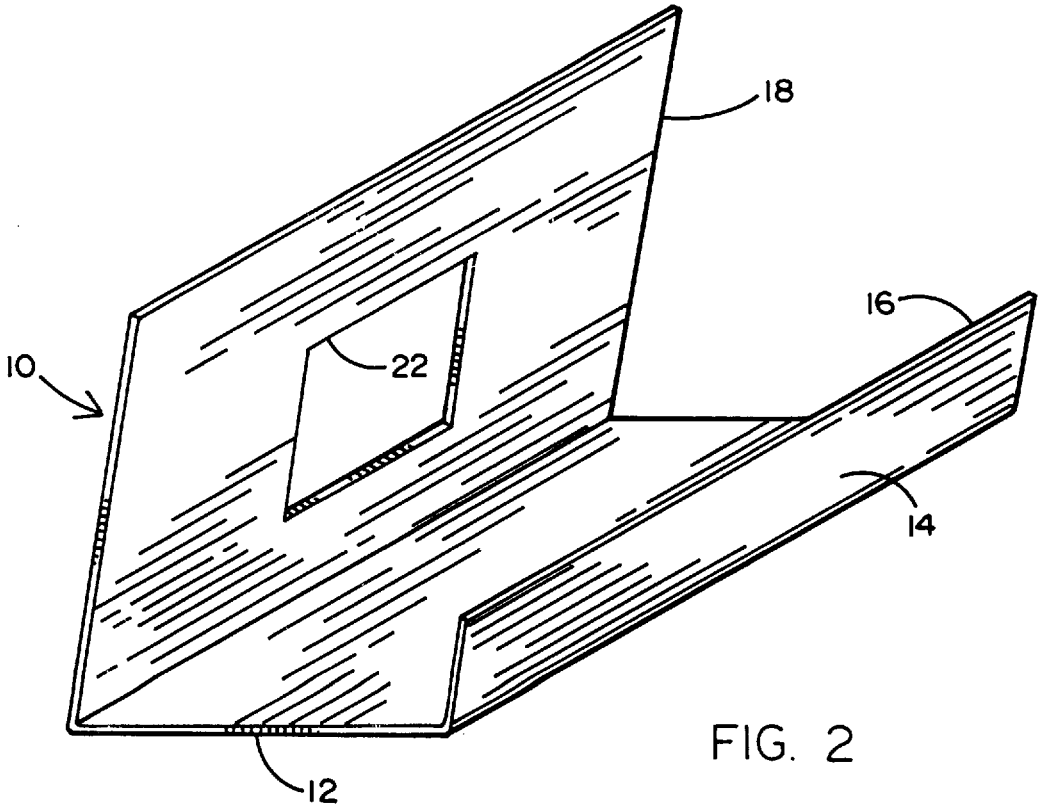
FIG. 2 is a rear perspective view of the tile-holding fixture in accordance with this invention.

There is an adhesive opening 22 through the fixture. wall. Preferably, the adhesive opening 22 is rectangular with the top and bottom edges parallel to the plane of base 12. The side-edges of the adhesive opening are preferably at a right angle to the top and bottom edges. This defines a rectangular or square opening. Adjacent the opening, secured to the face of the fixture wall are first and second stops 24 and 26. The first and second stops are positioned adjacent the edges of the adhesive opening. As seen in FIG. 1, the first and second stops are each straight, are each respectably parallel to the edge and bottom of the opening, and are spaced away from those edges.

An alternative construction for the stops is to use three pins. Two would lie adjacent and parallel to the bottom edge of the opening and the other would lie adjacent one of the upright edges. Adjutability of the pins could be by selecting one of several pin holes for placement of the pins.

Figure 4:
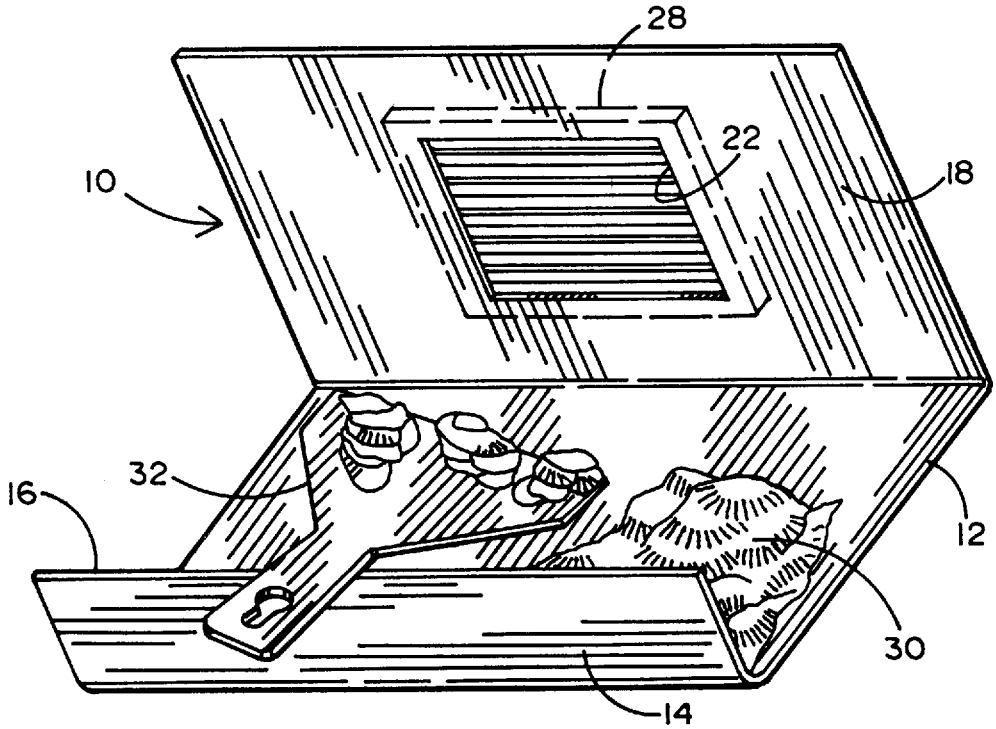
FIG. 4 is a rear perspective view, similar to FIG. 3, and also showing the adhesive applicator.

The size of the opening and the position of the stops are related to the size of a particular tile 28 for which the fixture 10 is suited. The tile is larger than the opening, as seen in FIG. 4. The stops are positioned so that the tile lies with its edges overlapping the opening substantially an equal amount on each edge. The stops 24 and 26 may be adjustable or they may be fixed, as shown in FIG. 1.

A convenient way of making the fixture is to form it out of sheet metal, such as sheet steel or sheet aluminum. If sheet steel is used, it preferably would be stainless steel or suitably plated to avoid rusting. When the fixture is made out of sheet metal, the first and second stops 24 and 26 can be made of angle metal spot-welded to the face. Another suitable material is thermoplastic synthetic polymer composition material in sheet form. Such material can be bent to shape by thermal softening and the opening cut therein. The stops would be adhesively attached.

Figure 5:
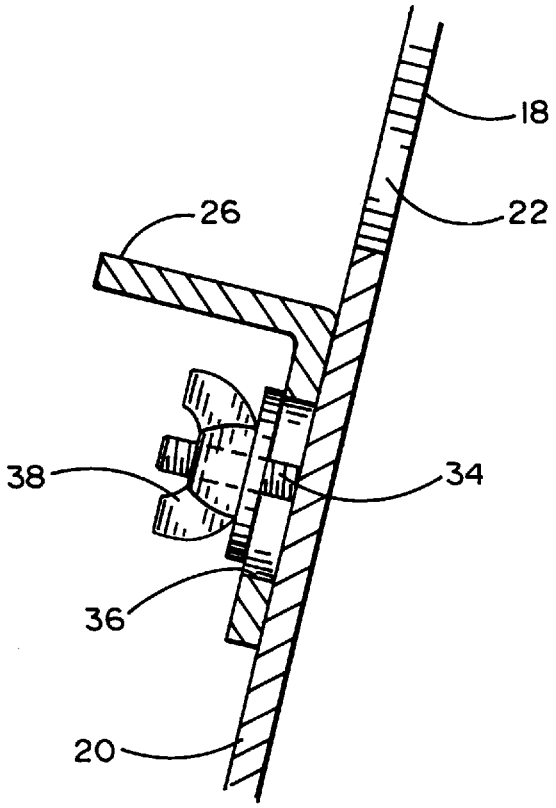
FIG. 5 is an enlarged section through an embodiment with adjustable stops showing the stop locking stud for adjusting the stop position.

As seen in FIG. 5, the stops may be adjustable with respect-to the adhesive opening 22. The face of fixture wall 18 has a stud 34 secured thereto, such as by welding. The stud passes through an enlarged hole 36 in the flange of stop 26 which engages against the face 20. Thumb nut 38 with a washer thereunder locks the stop against the face when the thumb nut is tightened. In this way, the stop can be adjusted with respect to adhesive opening 22 to achieve the desired relationship of the tile with respect to the opening. The first stop 24 is adjustable in a similar way.

In use, tiling adhesive 30 is placed on the top surface of base 12 between the scraper wall and fixture wall. A tile 28 is placed against both the front face and the stops and is held in place by the tiler, such as with his left hand when the tiler faces the fixture 10, as seen in FIG. 3. Thereupon, the tiler picks up the adhesive applicator 32 by its handle, uses it to pick up some of the tiling adhesive along its edge, and thereupon wipes the adhesive-carrying blade edge of the adhesive applicator across the inner face of the fixture wall 18 so as to fill the adhesive opening 22 with adhesive. Since the tile 28 is against its stops, it does not move.

When a straight edged applicator knife is used, the minimum depth of adhesive applied to the back of the tile is controlled by the thickness of the mask. A greater thickness of adhesive can be applied by using controlled hand pressure on the knife, to leave more adhesive on the surface. If this hand control method is too inexact for an inexperienced tiler, a notched adhesive spreader can be used.

Since the tile overlaps the adhesive opening, its edges do not receive adhesive. The tiler then picks up the tile 28 from fixture 10 in his left hand and places it on the substrate. The tiler may rest his adhesive applicator 32 with its handle lying on top of the scraper wall 14 during the tile setting so that he has both hands available. In this position, the adhesive applicator is conveniently available and the adhesive thereon does not become deposited on surfaces where it is unwanted.

The tiler places a new tile 28 against the stops, picks up the adhesive applicator 32, and wipes the adhesive off against the scraper edge 16. In this way, he can then pick up a new application of adhesive for wiping against the adhesive opening. The adhesive applicator rest, the adhesive applicator scraper edge, and the positioning of available adhesive are all convenient for fast and accurate tiling.

This invention has been described in its presently contemplated best embodiment, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A tile-holding fixture comprising:

a base;

a fixture wall mounted on said base and upstanding from said base, said fixture wall having a face and a back, an adhesive opening through said fixture wall from said face to said back;

means on said face of said fixture wall for positioning a tile against said face and with respect to said adhesive opening so that adhesive can be applied to said tile from the back of said fixture wall through said adhesive opening.

2. The tile-holding fixture of claim 1 wherein said fixture wall is at an acute angle with respect to said base.

3. The tile-holding fixture of claim 1 wherein there is a scraper wall mounted on said base, said scraper wall being positioned away from said fixture wall.

4. The tile-holding fixture of claim 3 wherein said fixture wall extends a greater distance from said base than said scraper wall.

5. The tile-holding fixture of claim 4 wherein said scraper wall is substantially parallel to said fixture wall.

6. The tile-holding fixture of claim 5 wherein said base, said fixture wall and said scraper wall are formed of bent sheet material.

7. The tile-holding fixture of claim 1 wherein said means for positioning said tile with respect to said adhesive opening comprises first and second stops attached to the face of said fixture wall adjacent said opening, said first and second stops being positioned with respect to each other so that said first and second stops position said tile in two directions.

8. The tile-holding fixture of claim 7 wherein each of said first and second stops has a straight stop edge.

9. The tile-holding fixture of claim 7 wherein each of said stops is adjustably mounted on said face of said fixture wall.

10. The tile-holding fixture of claim 8 wherein there is a scraper wall mounted on said base, said scraper wall being positioned away from said fixture wall.

11. The tile-holding fixture of claim 10 wherein said fixture wall extends a greater distance from said base than said scraper wall.

12. The tile-holding fixture of claim 11 wherein said scraper wall is substantially parallel to said fixture wall.

13. The tile-holding fixture of claim 12 wherein said base, said fixture wall and said scraper wall are formed of sheet metal.

14. A tile-holding fixture comprising:

a base, a fixture wall secured to said base, a scraper wall affixed to said base spaced from said fixture wall so as to leave a space on said base between said walls for the storage of adhesive, said fixture wall extending higher from said base than said scraper wall;

said fixture wall having a face and a back, said back of said fixture wall facing said scraper wall, an opening through said fixture wall from said face to said back, said opening being sized to apply adhesive to the back of a tile which lies against said face of said fixture wall over said opening; and stop means on said face of said fixture wall for positioning a tile with respect to said opening.

15. The tile-holding fixture of claim 14 wherein said fixture wall is at an acute angle with respect to said base.

16. The tile-holding fixture of claim 15 wherein said scraper wall is substantially parallel to said fixture wall.

17. The tile-holding fixture of claim 14 wherein said stop means comprises first and second stops attached to said face, said stops being positioned to locate a tile in two directions with respect to said opening.

18. The tile-holding fixture of claim 17 wherein said first and second stops are adjustable with respect to said opening.

19. The tile-holding fixture of claim 14 wherein said scraper wall is sized and positioned so that an adhesive applicator may be scraped thereon and may be rested thereagainst.

20. The tile-holding fixture of claim 19 wherein said scraper wall is sized and positioned so as to form a space on said base between said fixture wall and said scraper wall for the retention of adhesive.

* * * * *